United States Patent [19]

Gould

[11] 4,100,594

[45] Jul. 11, 1978

[54] SUPPRESSION OF COLOR FRINGING IN LAMPS

[75] Inventor: Allan Victor Stewart Gould, London, England

[73] Assignee: Thorn Electrical Industries Limited, London, England

[21] Appl. No.: 716,577

[22] Filed: Aug. 23, 1976

[51] Int. Cl.[2] ..... F21M 3/00; F21P 5/00

[52] U.S. Cl. ..... 362/308

[58] Field of Search ..... 240/41 R, 41.4, 41.15, 240/3, 47, 46.01, 41.3

[56] References Cited

U.S. PATENT DOCUMENTS

| | | | |
|---|---|---|---|
| 3,914,593 | 10/1975 | Laribe | 240/7.1 R X |
| 3,949,214 | 4/1976 | Jones et al. | 240/46.01 X |
| 3,955,077 | 5/1976 | Jones et al. | 240/7.1 R X |
| 3,999,056 | 12/1976 | Faulhaber | 240/41 R |

*Primary Examiner*—Richard L. Moses

*Attorney, Agent, or Firm*—Robert F. O'Connell

[57] ABSTRACT

In a beam-projecting lamp such as a vehicle headlamp or theatre spotlight which has a mask to delimit the edge of the beam, color fringing due to the mask is reduced by the use of a mask having separate front and rear edges or by splitting the projection lens into upper and lower halves, the arrangement in each case producing both a virtual erect mask image from one half of the projection lens and a real inverted mask image from the other half.

13 Claims, 12 Drawing Figures

10
12
14
16
18
20
22
24
26
28
30
32

SUPPRESSION OF COLOR FRINGING IN LAMPS

This invention relates to lamps such as vehicle lamps which can project a beam of illuminating light. The invention is particularly concerned with the suppression of colour fringing in such beams.

Basically a known projector illuminating system consists of a bulb, whose filament is placed at the first focus of an ellipsoidal reflector or condensing lens, and this illuminates a 'gate' or mask at, or near, the second focus. The illumination pattern at the mask is then focussed onto the scene to be illuminated by a projector lens. The two main applications for this type of system are 'gated' theatre spot lights and vehicle headlights.

When used solely for illumination, the projector lens is usually reduced to a single element lens, sometimes of the Fresnel type. A major problem which results from this is that if one tries to achieve a sharply defined cut-off, the inevitable colour aberration of a single element lens produces strong colour fringing at the edge of the projected beam. In a vehicle headlight system this is considered unacceptable because to an oncoming driver whose eyes are located in these coloured zones, the headlight will appear to be coloured. If his eyes are in the blue part of the fringe, the headlight may look like the blue light used by the emergency services and if his eyes are in the red zone, the headlight may be mistaken for a rear light. Known prior art has consisted of various methods of blurring or spreading the wanted white light to cover the coloured fringes, but this results in an unsharp cut-off with the undesirable effect of light illuminating the region beyond the cut-off. The present invention seeks to provide a lamp which as described in the embodiments can suppress the coloured fringes while retaining a sharp cut-off.

The present invention provides a lamp having an optical system comprising a light source, a projection lens composed of first and second parts disposed on opposite sides of a plane, a single mask or a pair of masks disposed between the light source and the projection lens to define a cut-off in the projected beam, the said pair of masks comprising a nearer mask which is nearer to the projection lens and a further mask which is further from the projection lens, the aperture of the said projection lens comprising first and second parts which substantially correspond with the masked and unmasked areas of the focal surface, respectively, the system further comprising an optical element for forming an image of the light source at or near the said single mask or between the pair of masks, wherein the single mask or the nearer mask is between the projection lens and the focus of the first part of the projection lens aperture whereby the said first part produces a virtual erect mask image and wherein the focus of the second part of the projection lens aperture is between the projection lens and the mask or the further mask whereby the said second part produces a real inverted mask image.

Lamps embodying the present invention may be constructed in a variety of ways.

In the preferred lamp, the projection lens is a single lens of constant focal length and two masks are used, one located beyond the focus of the lens and one closer than the focus. The two masks are placed substantially symmetrically about the focus of the projection lens and are preferably separated by between 2.5 and 25% of its focal length. For most lenses the surface of best focus is not plane and so ideally the two masks should be curved, so that the surface of best focus lies approximately midway between the edges of the masks. The masks should also be aligned and the profiles scaled in size, such that the edges of the two masks are approximately coincident, as viewed from the rear principal point of the projection lens. The mask-profiles can be at any angle.

In other constructions of lamps embodying the present invention, a single mask can be used. In this instance the two parts of the projection lens are given different focussing properties. In this instance, however, the mask profile needs to be approximately parallel to the plane separating the two different parts of the lens. The two parts can be of similar focal length but disposed at different positions along the axis of the optical system with their foci either side of the mask and can be identical half-lenses. Alternatively the two parts of the projection lens may be united but given a different focal length. In these systems it is preferred that the rear focal points of the two parts of the lens have a relative displacement, along the axis of the optical system, of between 2.5 and 25% of distance of the mask from the lens.

The way in which lamps embodying the present invention are able to suppress colour fringing will be described with reference to the drawings which illustrate embodiments incorporated in a vehicle headlight system designed to give a dipped beam pattern without any upward light.

Figures 1, 2, 3:
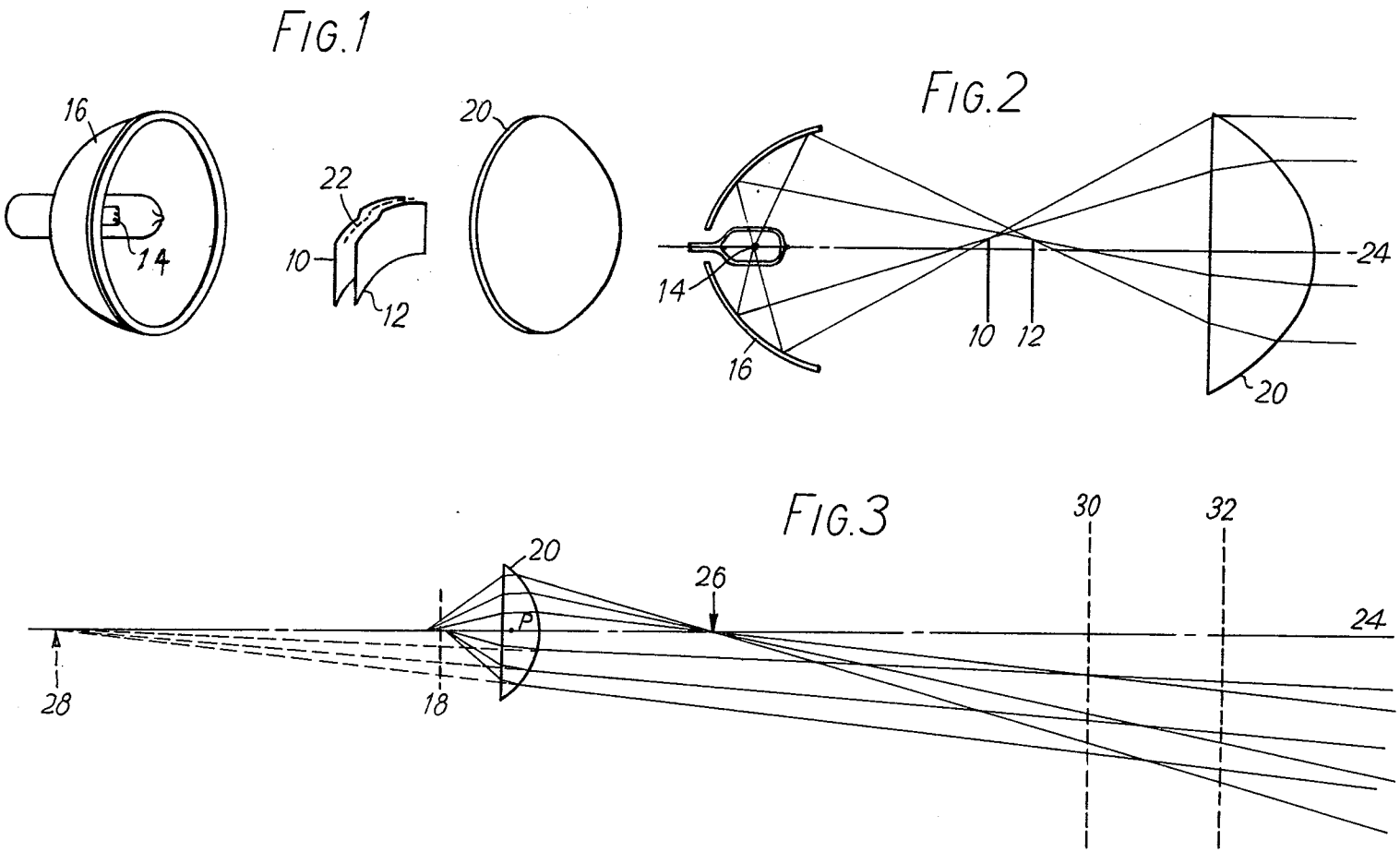
FIG. 1 is a perspective view of an embodiment of the preferred form of lamp having two masks and a complete lens of constant focal length.
FIG. 2 is an optical diagram of the embodiment of FIG. 1.
FIG. 3 is an exaggerated version of part of the optical diagram of FIG. 2 for illustrating the principles of the present invention.

Referring to FIG. 1, the embodiment consists of two masks 10 and 12 with similarly shaped opaque silhouettes, illuminated by a filament 14 at the first focus of an ellipsoidal mirror 16. The masks are placed approximately symmetrically about the focus 18 of a projection lens 20 and separated by about 10% of its focal length. The two masks 10 and 12 are curved since the surface of best focus is not plane. In this way the surface 22 of best focus lies approximately midway between the edges of the masks 10 and 12. The masks are aligned and their profiles are such that the edges of the two masks are approximately coincident when viewed from the rear principal point (P in FIG. 3) of the projection lens 20.

FIG. 2 shows typical bundles of rays illuminating the edges of the two masks 10 and 12 and illustrates how the top half of the lens 20 above the axis 24 of the system 'sees' only the silhouette of the back mask 10, whereas the bottom half of the lens 20 'sees' only the front mask 12. As will be explained in more detail with reference to FIG. 3, the two halves of the lens, each seeing a different, defocussed mask, form images such that the strongly coloured rays are superimposed on the brightly illuminated area of the projected beam pattern where they have little effect on the overall colour of the light while the least coloured rays form the sharp cut-off edge and a region of reduced brightness adjacent to it. Another benefit of this design is that the depth of focus (tolerance to defocussing of the lens) is increased by use of the double mask. Increasing the separation of the two masks 10 and 12 increases the depth of focus, but at the expense of an increased width of the reduced brightness zone adjacent to the cut-off.

In order to minimise the amount of stray light appearing beyond the cut-off, it is desirable that the edge of the front mask 12 does not produce significant grazing incidence reflection. This can be achieved by using thin material (say 0.05 mm), or by chamfering the edge if using thicker material, or by treating the edge with a non-reflective paint or chemical. Furthermore blackening of the front face of the front mask will stop the light reflected back by the surface of the projection lens 20 from being reflected forward again where it could illuminate the region beyond the cut-off.

Referring to FIG. 3, the separation of the two masks 10 and 12 has been increased in order to exaggerate the angles of the rays to make them easier to follow. This also brings the images of the masks closer to the lens so that they can all be shown on one diagram, but it has resulted in the desired zone of suppressed colour fringing being much compressed and brought closer to the lens. In practice the images of the masks would be about half a meter away from the lens and the zone of suppressed colour fringing could extend from about 5 meters to infinity.

In FIG. 3, rays illuminating the edge of the back mask 10 can only reach the top half of the lens 20 (rays which head towards the bottom half of the lens are blocked by the front mask 12). Because the mask 10 is further from the lens 20 than the infinity focus 18, a real inverted image 26 of the mask 10 is formed in front of the lens 20. Of the rays which form this image 26 those near the axis 24 are free of colour while those near the top edge of the lens 20 produce a strong orange/red fringe.

The edge of the front mask 12 can only be illuminated by rays which are heading down towards the bottom half of the lens 20. These rays are diverging when they leave the lens, appearing to come from an erect virtual image 28 of the front mask 12, because mask 12 is nearer to the lens than the infinity focus 18. Rays near the axis 24 are free of colour whereas rays near the bottom edge of the lens 20 produce a strong blue colour.

By following the rays along to the zone of suppressed colour fringing, located between the dotted lines 30 and 32, it can be seen that only the rays from the centre of the lens 20, which are free of colour, illuminate the region close to the cut-off thus producing a region of reduced brightness adjacent to the cut-off, free of colour. The strongly coloured rays, which all arrive much further from the cut-off are swamped by the full intensity of white light and thus only produce a slight contribution to the overall colour of the light.

Figure 5:
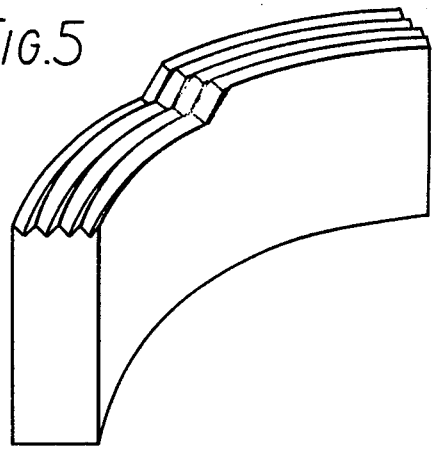
FIGS. 4 and 5 are perspective views of alternative masks for use in the embodiment of FIG. 1.
Figure 4:
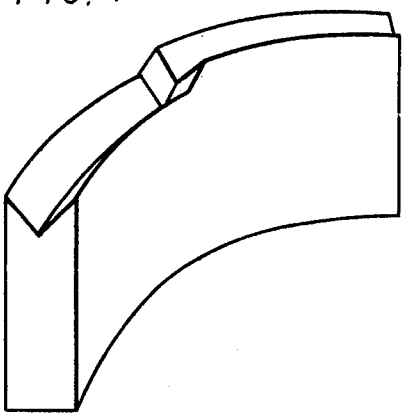

The two mask profiles can be produced as the opposite edges of a single 'thick' piece of an opaque substance, provied that the surface between the two edges is suitably reissed (i.e. has a broken, roughened or ridged surface to inhibit reflections) and/or treated with a chemical or paint to eliminate reflections from it. FIGS. 4 and 5 illustrate such masks.

It is also possible that one or both masks could be coatings deposited on a transparent substrate. Only one coating needs to be opaque throughout the masked area, the other coating need only be opaque in a region adjacent to the mask profile. It is possible to have the coatings deposited on opposite faces of a single transparent substrate. Furthermore, it will readily be appreciated that a mask can be part of a plate interposed between the light source and lens. The plate, which can be doubled, would then have an aperture to allow light from the source through to that part of the lens which forms the real inverted image. As previously, the plate should be curved to fit the focal surface, and if a double plate is used to form two masks then the edges should be aligned as viewed from the principal point P.

Figure 6:
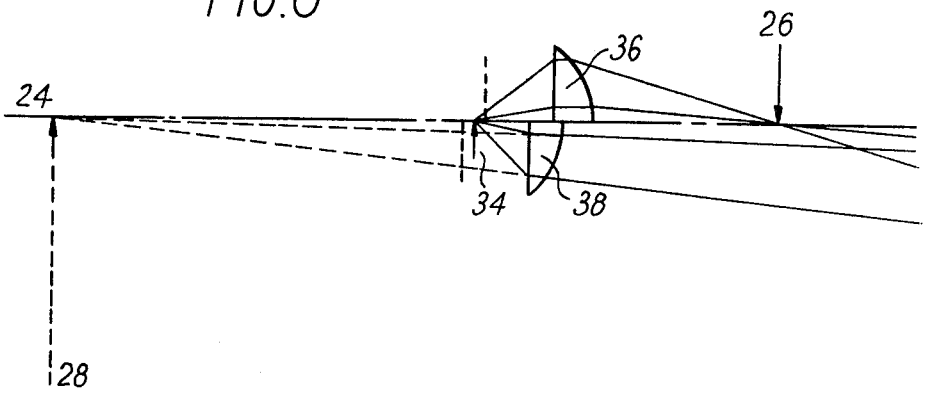

FIG. 6 illustrates an alternative way in which images of the mask from the top and bottom halves of a lens can be produced similar to those produced by the double mask. A single mask 34 is employed with two half lenses 36 and 38 of the same focal length placed at different distances along the axis 24. The upper half lens 36 produces the real inverted image 26 while the lower half lens 38 produces the erect virtual image 28. As with all the embodiments, the mask 34 should ideally be curved to match the surface of best focus.

Figure 7:
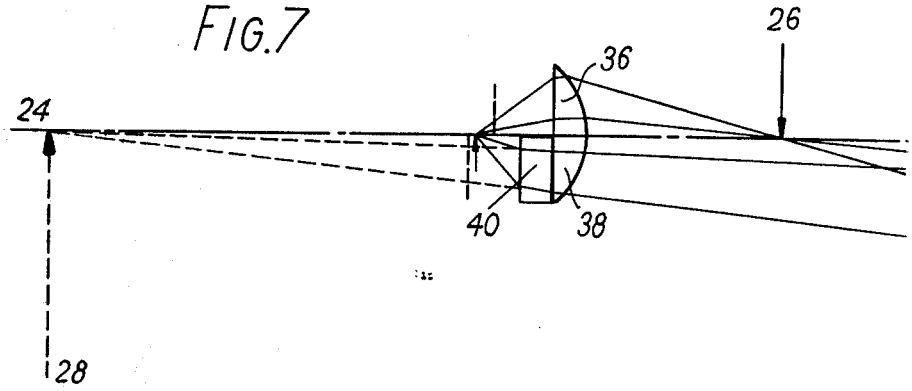

As shown in FIG. 7, another method of achieving the same effect is to place a parallel-sided block of transparent material 40 behind the lower half 38 of the lens. As an alternative, the block of transparent substance could be in the form of a shell with concentric faces whose centre lies near the middle of the mask edge. This has the effect of shifting the focus $F_2$ of the lower half 38 of the lens to beyond the mask 34. Since the focus $F_1$ of the upper half 36 of the lens is closer than the mask, the two different images 26 and 28 are obtained.

Figure 8:
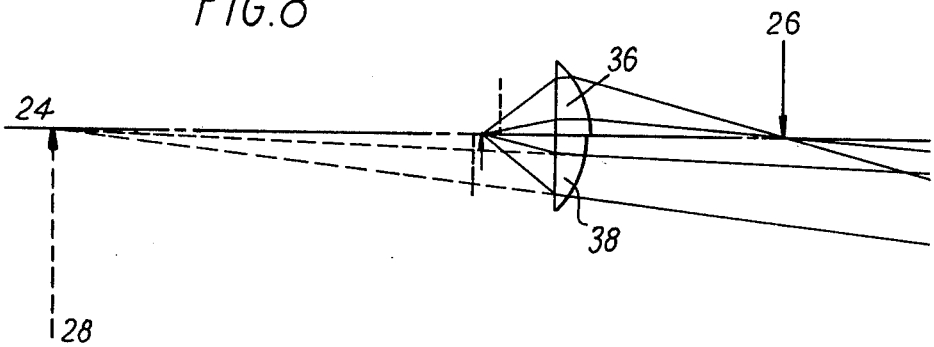

FIG. 8 illustrates an arrangement wherein the upper half 36 of the lens has a shorter focal length than the bottom half 38. In this way the disposition of the foci $F_1$, $F_2$ is as before and the colour suppression is observed.

Figure 9:
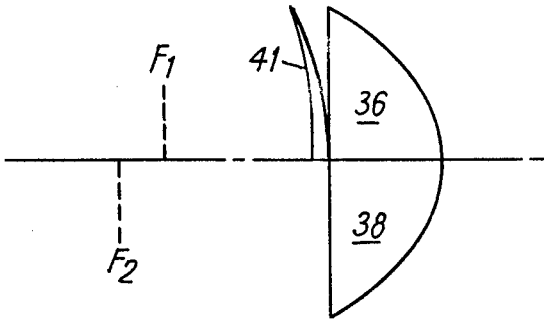
FIGS. 6, 7, 8, 9 and 10 are optical diagrams which illustrate five forms of projection lens which can be used with a single mask.
Figure 10:
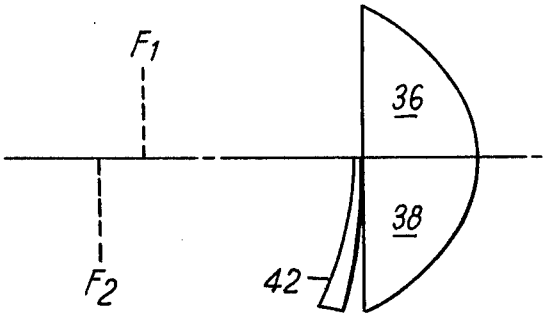

FIGS. 9 and 10 show further possible constructions wherein the disposition of the foci $F_1$, $F_2$ is arranged as before. In FIG. 9 the focal length of the upper half 36 of the lens is decreased by the addition of a separate half lens 41 of positive power. In FIG. 10 the focal length of the lower half 38 of the lens is increased by the addition of a separate half lens 42 of negative power.

It is quite possible to use combinations of two or more of the above methods to achieve the same optical effect. For example, it would be possible to have a double mask, a lens in two parts with an axial displacement between them, and with one part of the lens of shorter focal length than the other, in order to produce a similar optical effect to that produced by the individual systems described above. Furthermore, any of the lenses mentioned above could, in principle, be replaced by an equivalent Fresnel lens.

The single mask for the embodiments of FIGS. 6 to 10 may be formed in a similar manner to the technics discussed for one or both of the pair of masks. Thus the single mask may be a coating on a transparent substrate, or part of an interposed plate.

Figure 11:
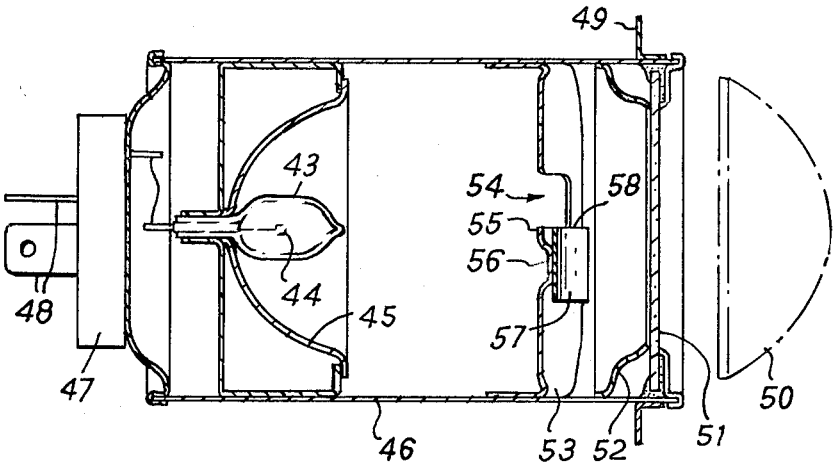
FIGS. 11 and 12 are respectively a longitudinal section and a front view of a motor vehicle headlamp in accordance with the invention.
Figure 12:
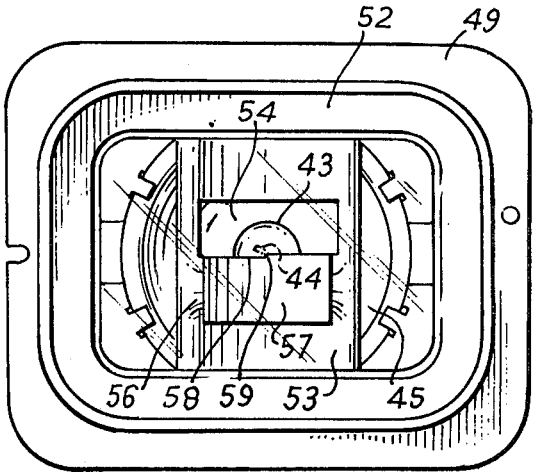

In the headlamp shown in FIGS. 11 and 12 a tungsten/halogen light source comprising a bulb 43 enclosing a filament 44 is mounted in a reflector 45 which is supported in a casing 46. The casing 46 has a standard base 47 with terminals 48 for making electrical connection to the lamp filament 44. At the forward end of the casing there is an external mounting flange 49. In this instance a projection lens 50 is separately supported in front of the casing but in other instances it is convenient to mount the projection lens in the casing. The front end of the casing 46 is sealed by a window 51 and immediately behind the window 51 is a diaphragm 52 defining the overall shape of the window opening.

Mounted within the casing 46 is a mask plate 53 having a generally rectangular aperture 54. It will be seen that the mask plate 53 is curved about a vertical axis to follow the plane of best focus of the lens 50. The lower edge 55 of the aperture 54 lies close to the level of the optical axis of the system. Below the edge 55 the mask 53 is formed with a horizontal rib 56 which projects forwards towards the lens 50 and supports an auxiliary mask plate 57. The upper edge 58 of the plate 57 has the same profile as the edge 55, consisting of two horizontal parts separated by a step 59. The mask edges 58 and 55 lie at the same level but are spaced apart along the optical axis by the rib 56.

I claim:

1. A lamp having an optical system for reduction of colour fringing comprising a light source, a projection lens, a mask disposed between the light source and the projection lens to define a cut-off in the projected beam and an optical element forming an image of the light source at or near the mask characterised in that for the mask comprises a nearer mask element which is nearer to the projection lens and a further mask element which is further from the projection lens, the said optical element forming a light source image between the said mask elements, the projection lens has first and second parts which are aligned generally with the masked and unmasked areas of the light source image, the nearer mask element is between the projection lens and the focus of the said first part of the projection lens whereby the said first part produces a virtual erect mask image and the further mask element is located between the light source and the focus of the second part of the projection lens whereby the second part produces a real inverted mask image.

2. A lamp as claimed in claim 1 in which the projection lens is a single lens whose first and second parts have the same focus.

3. A lamp as claimed in claim 2 in which the nearer and further mask elements are disposed substantially symmetrically about the focus of the projection lens.

4. A lamp as claimed in claim 3 in which the spacing of the mask elements is between 2.5 and 25% of the focal length of the projection lens.

5. A lamp as claimed in claim 3 in which the mask elements are curved so that the surface of best focus lies approximately midway between the mask elements.

6. A lamp as claimed in claim 2 in which the profiles of the mask elements are such that the edges of the mask elements are substantially coincident as viewed from the rear principal point of the projection lens.

7. A lens as claimed in claim 1 in which the mask elements are formed by opposite edges of a single piece of opaque material, the surface of the piece between the edges being non-reflecting.

8. A lamp having an optical system for reduction of colour fringing comprising a light source, a projection lens, a mask disposed between the light source and the projection lens to define a cut-off in the projected beam, and an optical element for forming an image of the light source at or near the mask, characterised in that the projection lens has first and second parts which are aligned generally with the masked and unmasked areas of the light source image, respectively, the mask is between the projection lens and the focus of the said first part of the projection lens whereby the first part produces a virtual erect mask image and the mask is between the light source and the focus of the said second part of the projection lens whereby the said second part produces a real inverted mask image.

9. A lamp as claimed in claim 8 in which the two parts of the projection lens have the same focal length but are disposed at different positions along the axis of the optical system.

10. A lamp as claimed in claim 8 in which the projection lens is a two-component system, the first component being a complete lens common to both parts and the second component being associated with one part only of the projection lens to alter the focal length of the first component.

11. A lamp as claimed in claim 10 in which the second component is a parallel-sided block.

12. A lamp as claimed in claim 8 in which the rear focal points of the two parts of the projection lens have a separation along the axis of the optical system of between 2.5 and 25% of the distance of the mask from the projection lens.

13. A lamp as claimed in claim 1 wherein the nearer and further mask elements coincide to form a single mask.

* * * * *